United States Patent [19]

Bathum, Jr. et al.

[11] 4,218,046

[45] Aug. 19, 1980

[54] SAFETY OVERLOAD INDICATING WINCH LEVER RESETTABLE LOCKOUT MEANS

[75] Inventors: Roy N. Bathum, Jr., Mercer Island; Jerry L. Mallow, Kirkland, both of Wash.

[73] Assignee: Beebe Bros., Inc., Seattle, Wash.

[21] Appl. No.: 945,829

[22] Filed: Sep. 26, 1978

[51] Int. Cl.[2] ..... B66D 1/00; B66D 1/58

[52] U.S. Cl. ..... 254/266; 254/369; 74/524

[58] Field of Search ..... 254/169, 163, 164, 167, 254/168; 74/523, 524, 543, 545

[56] References Cited

U.S. PATENT DOCUMENTS

| | | | |
|---|---|---|---|
| 2,789,791 | 4/1957 | Carroll | 254/167 |
| 3,542,341 | 11/1970 | Stevens | 254/169 |
| 3,648,978 | 3/1972 | Ratcliff | 254/164 |
| 4,003,551 | 1/1977 | Wallace | 254/164 |

*Primary Examiner*—Edward J. McCarthy
*Attorney, Agent, or Firm*—Christensen, O'Connor, Johnson & Kindness

[57] ABSTRACT

A resettable lockout means for an overload indicating winch lever is disclosed that automatically trips in response to overload applied to the lever forcing the lever members out of normal operating alignment and actuating an associated overload indicator. The winch operator desiring to remove the tell-tale overload indication and to restore the members of the operating lever into normal operating alignment is required to reset the lockout device through a deliberate procedure involving removal of a lockout device holder, followed by manual resetting of the lockout device within the winch lever.

5 Claims, 8 Drawing Figures

SAFETY OVERLOAD INDICATING WINCH LEVER RESETTABLE LOCKOUT MEANS

BACKGROUND OF THE INVENTION

This invention relates to an improved safety device for lever operated chain hoists and other winches and is herein illustratively described by reference to its presently preferred embodiment. However, it will be recognized that certain modifications and changes therein will respect to details may be made without departing from the essential features involved.

In the interests of safety, lever operated hoists and winches are being equipped increasingly with articulated type operating levers with overload indicators that operate in response to the application of excessive force to the operating lever. When this occurs the outer member of the operating lever pivotally connected to the winch-mounted inner member thereof overcomes the resistance of an overload spring that normally holds the members in operating alignment. Yielding of the overload spring permits the outer member to shift through a small acute angle into an opposite limit position relative to the inner member. Such relative breaking movement between the lever members also operates an overload indicator such as a device that shows green in a viewing window when the lever members are in normal operating alignment and red when they are in the broken or overload responding relationship. In the past, a winch operator, negligent about safe operating limits of the winch, with very little added effort could quickly force the lever members back into their normal operating alignment and thereby escape notice by a safety inspector or job superintendent. As a consequence, and with little effort or delay required to reset the conventional overload handle, there was relatively little deterrent to improper usage of the equipment.

A broad object of the present invention is to provide a relatively inexpensive, effective and reliable lockout device that responds automatically to overload beak motion between the lever members so as to prevent resetting of the same and removing the overload indication until the winch operator has first manually reset the lockout device itself. A related object is to devise such a resettable safety lockout means for use in winches of this type that can be reset only upon certain deliberate operations that require actions not readily hidden or masked from observation by others, and in fact that are not overly simple, as a means to discourage repeated offenses in the misuse of the equipment.

A further object hereof is to devise such a resettable safety lockout means that is readily incorporated in commercially available types of safety overload indicating winch levers without adding materially to the weight or cost thereof.

Brief Description of Invention

In accordance with this invention, the resettable safety lockout means carried by the operating lever in the vicinity of the pivotal connection between its inner and outer members includes a first portion maintained in fixed position on one lever member and a second portion manually deflectable under resilient stress by placing it in the set position bearing slidably upon the other lever member with such members positioned in normal operating alignment. The second portion of the lockout means then snaps into its lockout position automatically upon relative overload movement between the lever members out of such alignment. A separate holder for the lockout means must then be removed and the lockout means reset before the lever members can be restored to normal operating alignment.

More specifically, the lockout means comprises a unitary resilient sheet metal strip cut and bent to comprise a base, a deflectable tail and a guide tab. Sharing a side recess in the lever with the overload spring device, the tail portion of the lockout strip is normally maintained under resilient pressure in sliding contact with an end portion of the outer lever member. When the lever members break out of normal operating alignment in response to overload, the tail portion snaps into the base of the recess where it serves as a positive barrier preventing return movement of the members of the lever into normal operating alignment.

A lockout holder means in the form of a cover plate applied to the operating lever over the recess maintains the base portion of the lockout strip in operating position and itself must first be removed in order to reset the lockout device and in the process thereof release the lever members to be returned into normal operating alignment.

These and other features, objects and advantages of the invention will become more fully evident as the description proceeds with reference to the accompanying drawings.

Detailed Description

Figure 1:
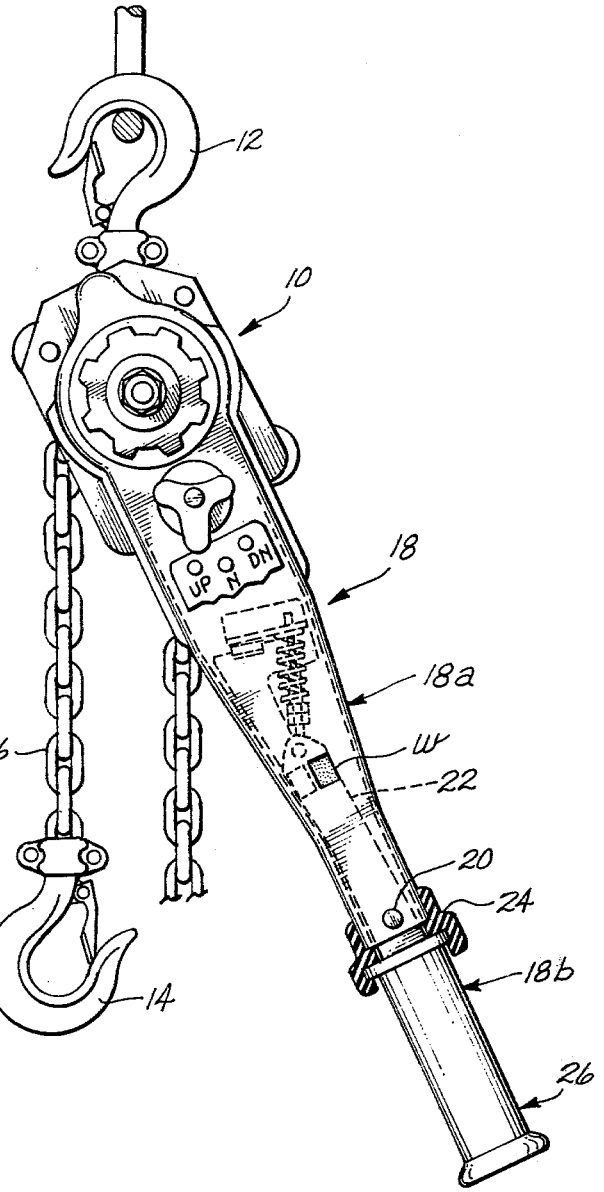
FIG. 1 is a side elevation of a conventional overload indicating winch with the invention incorporated and with the winch lever members in normal operating alignment.
Figure 2:
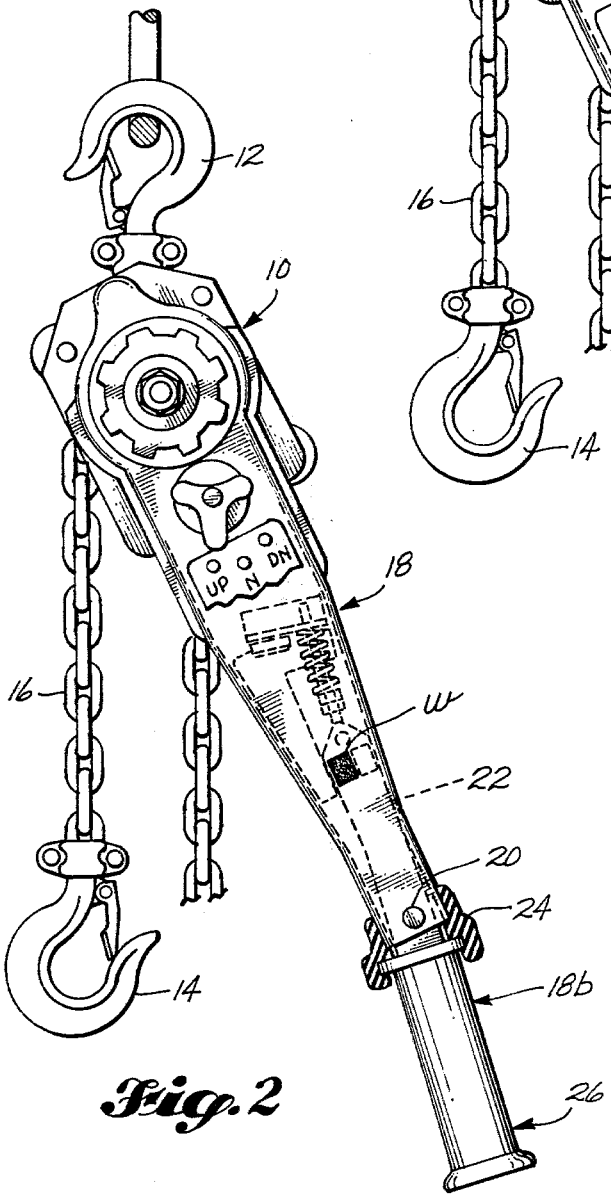
FIG. 2 is a view similar to FIG. 1 with the winch lever members broken out of operating alignment in response to overload force applied to the operating lever.

Referring to the drawings and more particularly to FIGS. 1 and 2, the disclosed winch depicted in the illustration as a chain hoist comprises a winch body 10, having a hanger hook 12, and adapted to raise and lower a load (not shown) carried by load hook 14 on the end of a chain 16. Operation of the winch to raise or lower the load is effected by repeated swinging of the winch operating lever 18 through an angular range so as to operate the ratcheting device in the winch with the requisite mechanical advantage gained partly through the length of the operating lever 18 and in many cases also partly through gearing incorporated in the body of the winch. The inner details and workings of the winch itself not shown in the drawings nor further described herein are of secondary concern and constitute no part of the present invention. Suffice it to say that the hoist version of the overload safety lever winch depicted in FIGS. 1 and 2 is a commercially available device and that the invention applies thereto as it also applies to other forms of winches incorporating articulated operating levers of the type that respond to applied overload by "breaking" or undergoing relative angular deflection of the two component members.

As shown, the operating lever 18 comprises an elongated inner member 18*a* operably connected to the winch and an elongated outer member 18*b* generally aligned with the inner member and pivotally connected thereto by means of a transverse pivot pin 20. The member 18*b* has an inner end portion 22 projecting lengthwise in overlapping relationship with the lever member 18*a* and socketed or accommodated within the hollow interior of the member 18*a*. Projecting out of the interior of the member 18*a* the outer lever member 18*b* is in the form of a hand grip 26, their joint being protectively surrounded and covered by a flexible rubber sleeve 24 that keeps out dirt and prevents hand injuries to the operator. Pivot pin 20 is held in place by a split ring snap connector 28 engaged in an annular slot around the projecting unheaded end of the pin.

Figure 7:
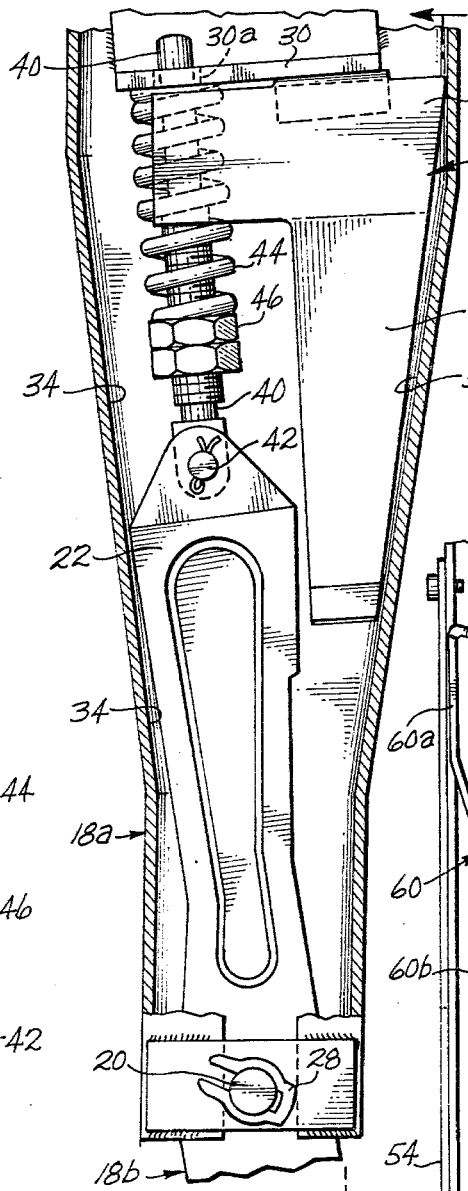
FIG. 7 is a view similar to FIG. 5 in which the lever members occupy the overload responsive position thereof and in which the lockout device has been actuated in response to overload so as to prevent resetting of the lever members without first resetting the lockout device.
Figure 8:
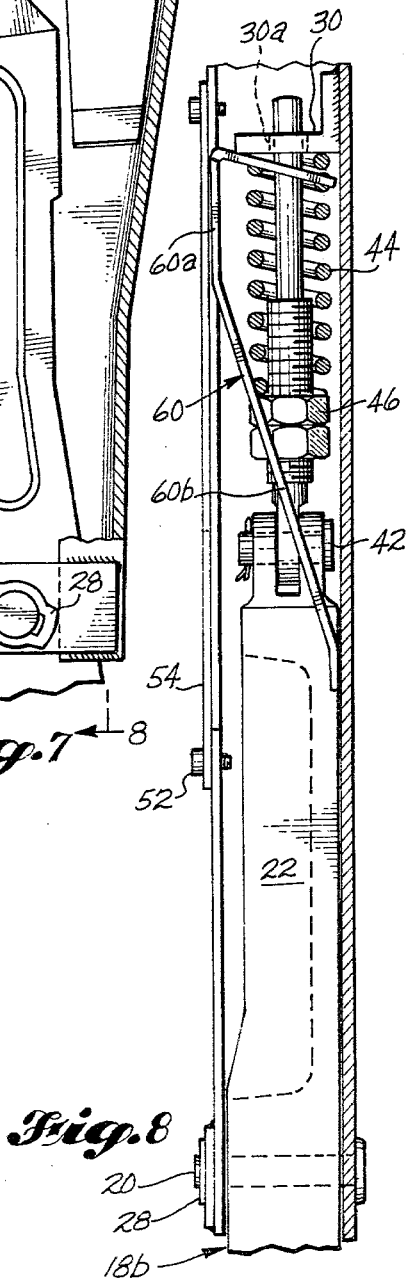
FIG. 8 is a side view of the same taken on line 8—8 in FIG. 7.

Within the interior socket space or recess S afforded by the lever member 18*a*, there is a stationary fitting 30 upstanding from the socket base or bottom wall 32 formed by the web portion of the formed sheet metal lever member. Opposite side walls 34 and 36 of the lever member defining opposite sides of the socket space serve as stops that limit the angular articulation movement of the outer member 18*b* in relation to the inner handle member 18*a*. The inner portion 22 of the member 18*b* bears against the side wall 36 as a stop with the lever members in normal operating alignment as depicted in FIG. 5 whereas it bears against the side wall 34 as a stop with the members in the mutually articulated or offset position which they assume in response to overload as depicted in FIG. 7.

An overcentering spring device holds the lever members in one limit position or the other. This device includes a rod 40 pivotally connected at one end by a pin 42 to the lever member end portion 22 and slidably received and guided in an aperture 30*a* in the fitting 30. A helical spring 44 surrounding the rod is maintained under compression between the fitting 30 and adjustable locknuts 46 carried by a threaded portion of rod 40 as shown (FIGS. 5 and 7). Recoil force of the spring 44 and the angular relationship of the rod 40 tends to maintain the outer lever member 18*b* in either of its limit positions, with an overcentering action involved in the working of the spring against relative angular motion between the lever members. However, the angular relationship is such that the greatest force of restraint tending to maintain the lever members in one limit position is that exerted with the members in normal operating alignment as depicted in FIG. 5. Thus in the broken or overload position as shown in FIG. 7 the force of the spring passes the pivot access of pin 20 more closely than it does in the other position so that the force required to return the lever members to normal operating position is relatively small.

The upper edges of the side walls 34 and 36 opposite the base wall 32 of inner lever member 18*a* are turned inwardly to form flanges 36*a* and 34*a* respectively with threaded fastener holes 50 formed therein to receive fastener screws 52 by which a cover plate 54 is held clamped against the open side of the recess S opposite the base wall 32. The cover plate not only protectively encases the spring merchanism just described but also serves a special holding function for the resettable lockout device illustrated and now to be described. As shown the lockout device comprises a unitary resilient sheet metal strip 60 cut and bent in a special configuration to include a base portion 60*a*, a narrower tail portion 60*b* projecting from one edge and adjacent one side of the base portion 60*a*, and a guide tab portion 60*c* projecting centrally from the opposite edge of the base portion 60*a*. In its relatively undeflected or relaxed position the tail portion 60*b* forms an obtuse angle of the order of 150° with a face of the base portion 60*a*. Similarly, the guide tab portion 60*c* forms an acute angle of the order of 75° with the same face of the base portion 60*a*. The base portion 60*a* including the guide tab 60*c* forms a fixed or first portion of the resettable lockout device. Tail 60*b*, forming a second portion of the lockout device, is resiliently deflectable in relation to the first portion. The base 60*a* is held in fixed position relative to the inner lever member by the clamping action of the cover plate 54 held in place by the securing screws 52 tightened in their receiving apertures 50.

Figure 5:
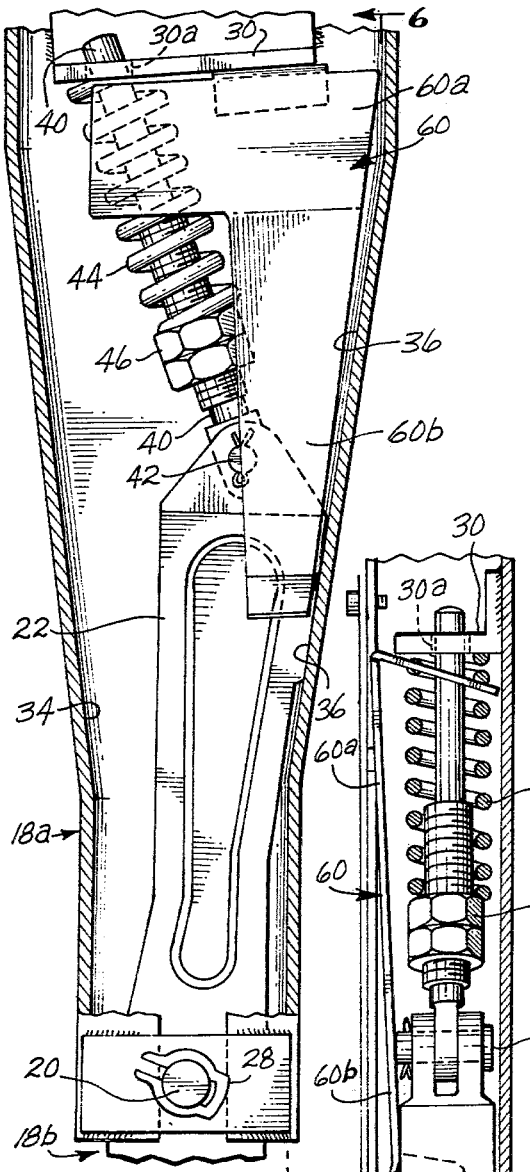
FIG. 5 is a fragmentary longitudinal sectional view of the overlapping pivotally interconnected portions of the lever members with parts removed and at an enlarged scale to illustrate the form and relationship of the resettable safety lockout means incorporated therein, showing the parts in the relative position of normal operating alignment of the lever members.
Figure 6:
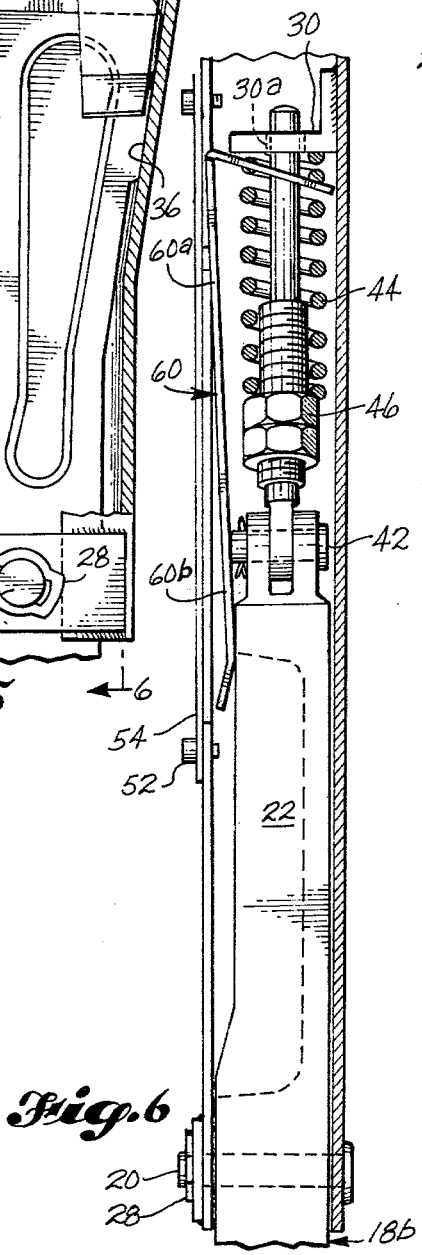
FIG. 6 is a side view of the same taken on line 6—6 in FIG. 5.

With the lever member 18*b* in its normal operating alignment position with the member 18*a* as shown in FIG. 5, the lockout device 60 is inserted into the socket space S of the member 18*a* by direct transverse inward movement using the angled guide tab 60*c* slidably bearing against the outer edge of the fitting 30 to guide and position the lockout device longitudinally of the lever. In this initial insertion, the tail portion 60*b* is placed on top of the inner end portion 22 of the lever member 18*b* where it remains in sliding contact under resilient stress created by cover plate 54 flattening the lockout device 60 as screws 52 are tightened in place. Thus when the outer member 18*b* pivots in relation to the inner member 18*a* under overload force overcoming spring 44 and the outer member inner portion 22 moves out from beneath the lockout device tail portion 60*b* the latter snaps abruptly downwardly against the base wall 32 in the space opened laterally between the inner portion 22 and the adjacent side wall 36. In this lockout position of the lockout device 60 the tail portion 60*b* thereof positively obstructs return movement of the outer level member 18*b* in relation to the inner member 18*a*. At that time a red panel mark on the base of the outer member portion 22 shows in the window W to indicate that the device has been overloaded and is indeed in the overload responsive position. Otherwise, with the lever members in normal operating alignment as shown in FIGS. 1 and 5 a green panel mark on the lever member portion 22 shows in the viewing window W.

Figure 3:
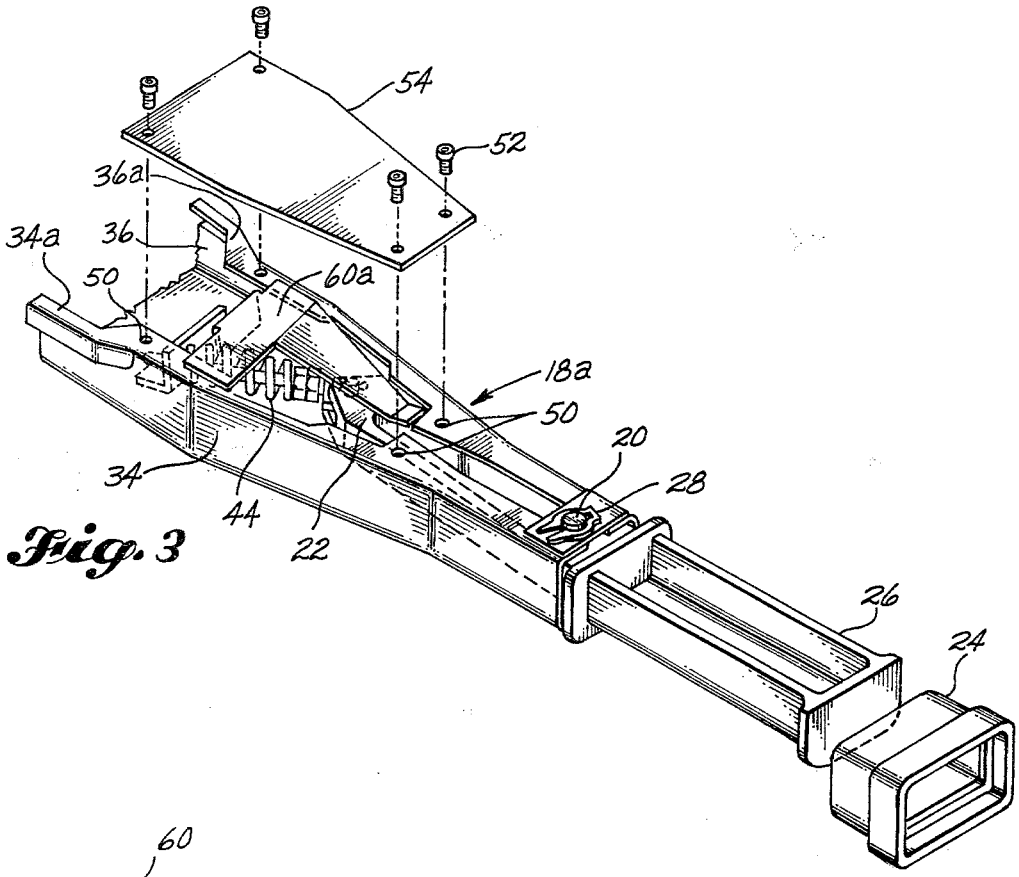
FIG. 3 is a fragmentary isometric view of the operating lever with parts removed to illustrate certain details and the form and manner of incorporating the lockout device in the lever.
Figure 4:
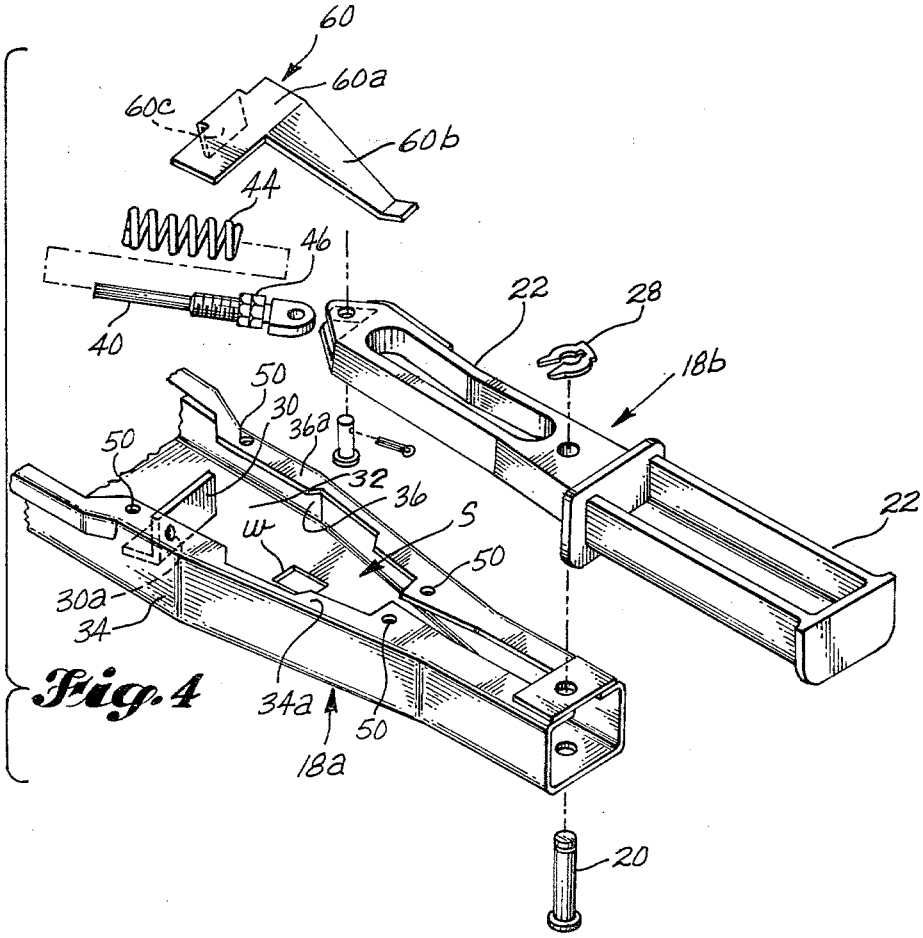
FIG. 4 is an exploded isometric view showing most of the assembly shown in FIG. 3, with the lever components in separated relationship.

In order to reset the mechanism into its normal operating alignment it is first necessary to physically remove the cover plate 54 so as to gain access to the lockout strip 60. When this is done the strip can be lifted from the recess S. This permits forcing the operating lever members back into their normal operating alignment position. At that juncture, the lockout device is reinstalled in reset position (FIGS. 3 and 5) and holding cover 54 restored to its clamping position screwed to flanges 34*a* and 36*a*.

It will be appreciated that the invention thus described is susceptible of minor variations or changes of design according to preference or to suit the specifics of particular lever arm designs to which the concept is applied.

The embodiments of the invention in which an exclusive property or privilege is claimed are defined as follows:

1. In combination with a manually operated winch including an articulated winch operating lever mounted on the winch to swing in an operating plane and comprising inner and outer elongated lever members, the inner member being operatively connected to the winch and the members being pivotally interconnected in general coalignment permitting the outer member to pivot in said plane relative to the inner member through an acute angle between limit positions, overload release spring means interconnecting the members adjacent the pivotal connection therebetween and normally urging the outer member into a first such limit position while being yieldable in response to winch overload force exerted on the outer member to permit pivoting thereof into the second limit position, resettable safety lockout means carried by said operating lever in the vicinity of said pivotal connection including a first portion maintained in fixed position on one lever member and a second portion manually deflectable relative to said first portion under resilient stress from a lockout position into a reset position, means on the other lever member releasably engageable by said second portion to maintain the latter in its reset position with the outer lever member in its first limit position and to release said second portion for resilient return to its lockout position with movement of the outer lever member into its second limit position, said second portion of the safety lockout means in its lockout position physically obstructing return movement of the outer lever member to its first limit position.

2. The combination defined in claim 1, wherein the outer member includes an end portion projecting lengthwise beyond the pivotal interconnection into longitudinally overlapping relationship with the inner member, overload safety indicator means including elements on the respective members cooperable upon such yielding to indicate overloading of the winch with the outer member in said second limit position, and wherein the inner member forms a socket that opens endwise toward the outer member and that receives said end portion thereof, said socket comprising a base wall generally parallel to said operating plane and two mutually spaced side walls transverse to said base wall that are alternatively engageable by said end portion in said first and second limit positions, respectively, said safety lockout means comprising unitary resilient sheet metal strip means removably received in said socket, and holder means having a normal position wherein it is fastened to the inner lever member for holding the strip operatively in said socket while barring manual access to the strip for resetting the same, said holder means being removable with the second lever member in its second limit position to permit access to and manual resetting of said lockout means.

3. The combination defined in claim 2, wherein the lockout means first portion comprises a substantially flat strip base portion normally held in said socket substantially parallel to said base wall and wherein the lockout means second portion comprises a generally flat tail portion narrower than the socket between said side walls and extending, with its plane at an obtuse angle to said base portion, generally longitudinally of the operating lever adjacent the socket side wall defining the first limit position, deflection of said tail portion under resilient stress into reset position, with accompanying increase of said obtuse angle, positioning the tail portion to press slidably against said end portion of the outer member in its first limit position, whereby movement of the lever outer member end portion to its second limit position permits said tail portion to snap into said lockout position interposed between the last-mentioned socket side wall and said outer member end portion.

4. The combination defined in claim 3, wherein the strip base portion is positioned in the socket on the side thereof opposite the base wall and wherein the holder means comprises a clamp plate removable secured to the inner lever member against said base portion.

5. The combination defined in claim 4, wherein the lockout means first portion includes a guide tab portion projecting from the base portion inwardly of the socket at an acute angle relative to said base portion of the order of seventy-five degrees, and wherein the inner lever member has a fixed transverse element in the socket slidably engageable by said guide tab portion during operative positioning of the lockout means.

* * * * *